US006498586B2

(12) United States Patent
Pankinaho

(10) Patent No.: US 6,498,586 B2
(45) Date of Patent: Dec. 24, 2002

(54) METHOD FOR COUPLING A SIGNAL AND AN ANTENNA STRUCTURE

(75) Inventor: Ilkka Pankinaho, Paimio (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/749,365

(22) Filed: Dec. 27, 2000

(65) Prior Publication Data

US 2001/0007445 A1 Jul. 12, 2001

(30) Foreign Application Priority Data

Dec. 30, 1999 (FI) ..... 19992833
May 2, 2000 (FI) ..... 20001023

(51) Int. Cl.[7] ..... H01Q 1/38; H01Q 1/24
(52) U.S. Cl. ..... 343/700 MS; 343/702
(58) Field of Search ..... 343/700 MS, 702, 343/846, 848, 725, 729; H01Q 1/38, 1/24

(56) References Cited

U.S. PATENT DOCUMENTS

| | | | | |
|---|---|---|---|---|
| 5,327,151 A | | 7/1994 | Egashira | 343/830 |
| 5,554,996 A | | 9/1996 | Chatzipetros | 343/702 |
| 6,137,445 A | * | 10/2000 | Ha et al. | 343/702 |
| 6,262,682 B1 | * | 7/2001 | Shibata | 343/700 MS |
| 6,297,776 B1 | * | 10/2001 | Pankinaho | 343/700 MS |

FOREIGN PATENT DOCUMENTS

| | | |
|---|---|---|
| EP | 0892459 A1 | 1/1999 |
| JP | 9307344 | 11/1997 |
| WO | WO 99/03166 | 1/1999 |

OTHER PUBLICATIONS

"A Compact PIFA Suitable for Dual–Frequency 900/1800–MHz Operation", Rowell et al., IEEE Transactions on Antennas and Propagation, vol. 46, No. 4, Apr. 1998.
"Dual Frequency Planar Inverted–F Antenna", Liu et al., IEEE Transactions on Antennas and Propagation, vol. 45, No. 10, Oct. 1997.
"Electrical Tuning of Integrated Mobile Phone Antennas", Louhos et al., Proceedings of the 1999 Antenna Applications Symposium, 1999.

* cited by examiner

*Primary Examiner*—Hoanganh Le
(74) *Attorney, Agent, or Firm*—Perman & Green, LLP

(57) ABSTRACT

The invention relates to a method for coupling a signal to an antenna structure, as well as to an antenna structure, which comprises at least two antenna elements (101, 102), a ground plane (105) for grounding the antenna structure, a coupling line (106) for coupling a first antenna element and a second antenna element to each other, and a feeding line (107) for feeding the antenna structure through one feeding point. The first antenna element (101) is next to the ground plane and perpendicular to the ground plane (105). The second antenna element (102) is above the ground plane and parallel to the ground plane. The first antenna element is arranged to receive information on a reception band of a broadband radio system and the second antenna element is arranged to transmit information on a transmission band of said broadband radio system. By arranging the second antenna element to be adjustable and by adding antenna element to the antenna structure, the antenna structure according to the invention can be used, for example, in mobile stations of $2^{nd}$ and $3^{rd}$ generation mobile communication systems.

33 Claims, 12 Drawing Sheets

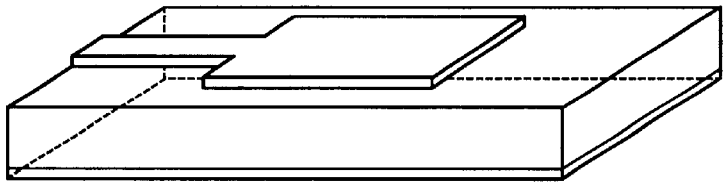
Fig. 1a "Prior Art"
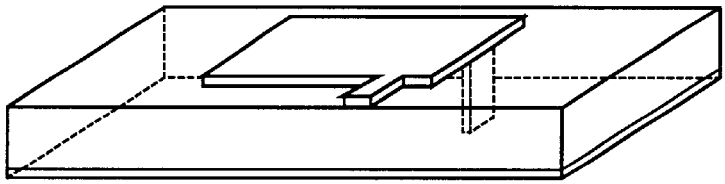
Fig. 2a "Prior Art"
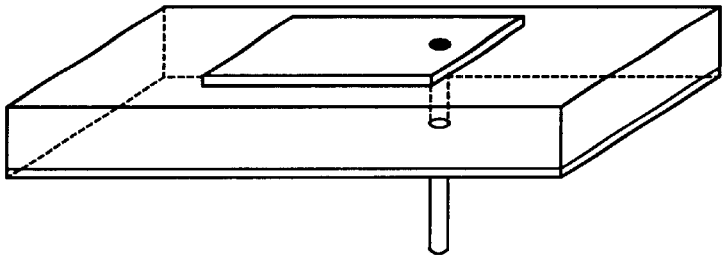
Fig. 1b "Prior Art"
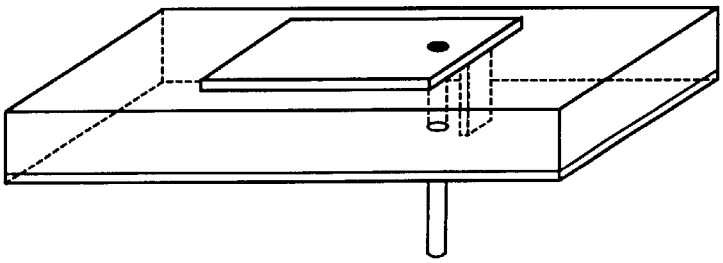
Fig. 2b "Prior Art"

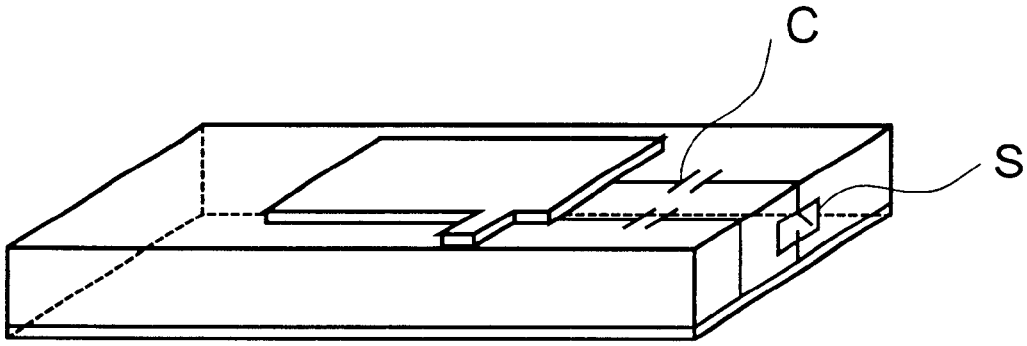
Fig. 5 "Prior Art"
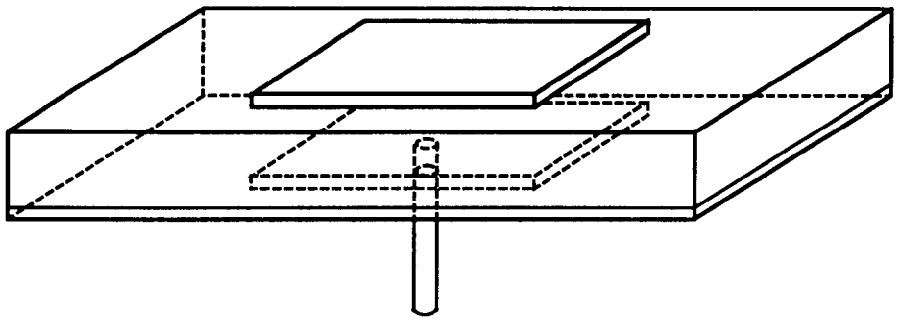
Fig. 3 "Prior Art"
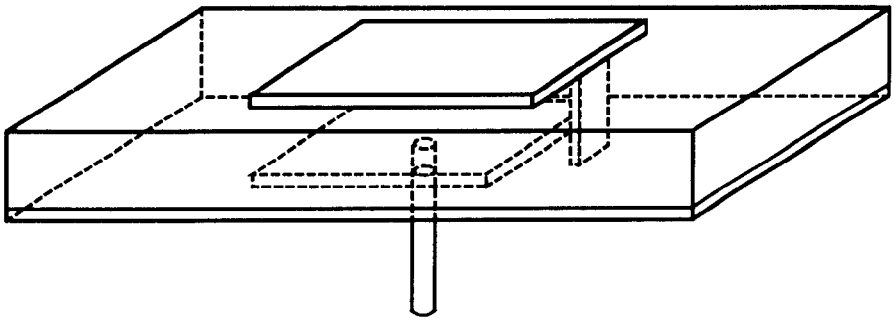
Fig. 4 "Prior Art"

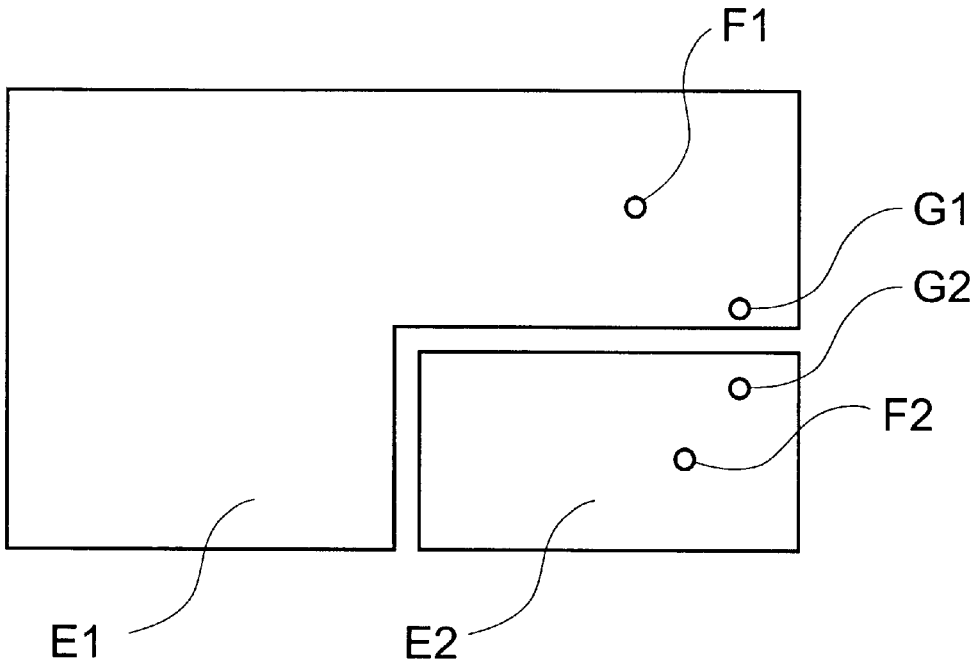
Fig. 6 "Prior Art"
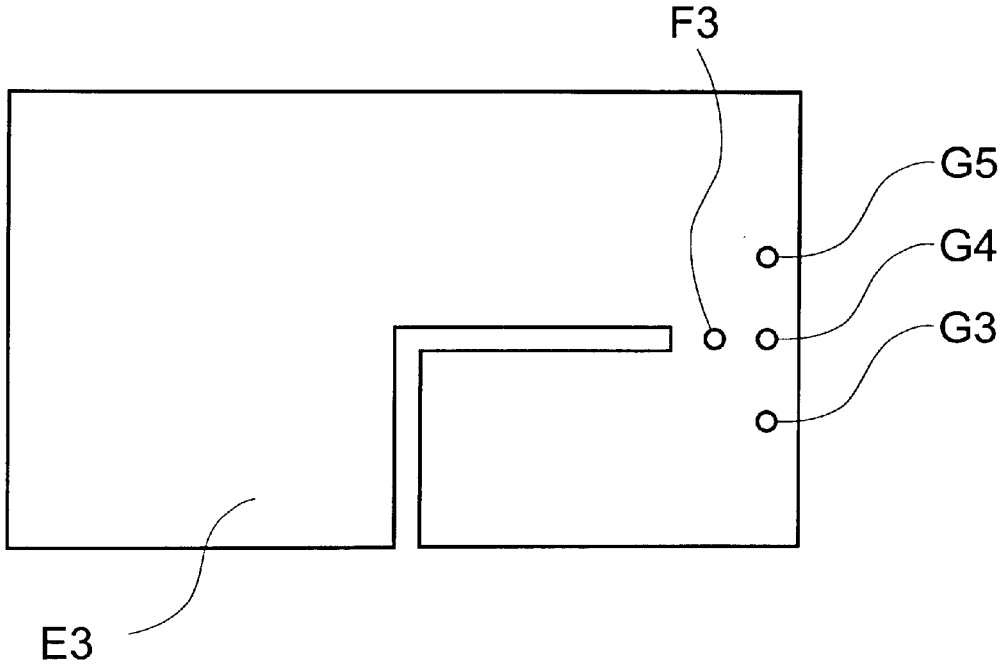
Fig. 7 "Prior Art"

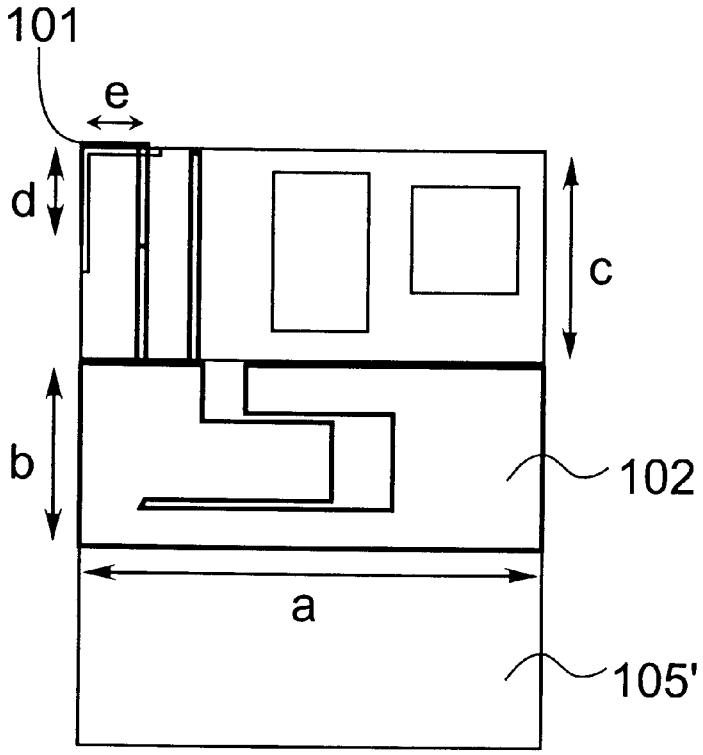
Top view
Dimensions :
a = 36 mm
b = 13 mm
c = 18 mm
d = 9 mm
e = 5 mm
f = 8 mm
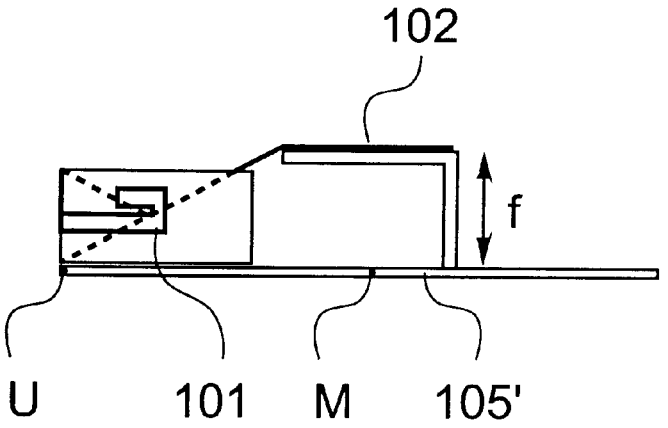
Side view
Fig. 19

METHOD FOR COUPLING A SIGNAL AND AN ANTENNA STRUCTURE

FIELD OF THE INVENTION

The present invention relates to small-sized microstrip antennas that operate on many different frequency bands. In particular, the invention relates to internal antennas used in mobile phones, which are fed from one feeding point.

BACKGROUND OF THE INVENTION

In the present patent application, a frequency range comprises one or more frequency bands, i.e. a frequency band is part of the frequency range. Furthermore, by the reception band is meant a frequency band reserved for downlink data transmission and by the transmission band is meant a frequency band reserved for uplink data transmission.

In mobile stations, there is going on a changeover to terminals that operate in several frequency ranges. Solutions of several frequency ranges like this include so-called dual band terminals currently in use, which operate in two frequency ranges.

Dual band terminals have been implemented by both an external and internal antenna. The external antenna, which can be, for example, monopole, helix or their combination, is demanding as for its manufacturing technique, and it breaks easily. Therefore, in mobile stations, there is going on an increasing changeover to internal antenna structures implemented by microstrip antennas. The advantage of internal antennas compared to external antennas is the ease of the manufacturing technique and the speeding up of the serial production as the degree of integration increases, as well as the more durable structure than that of the external antennas.

A conventional microstrip antenna comprises a ground plane and a radiating antenna element that is insulated from the ground plane by an insulating layer. The resonance frequency of the microstrip antenna is determined on the basis of the physical dimensions of the antenna element and the distance between the antenna element and the ground plane. The operating principle and dimensioning of microstrip antennas are well known and they are described in the literature relating to the field.

FIGS. 1*a* and 1*b* show a microstrip antenna and an L-plane antenna according to prior art, which hereinafter in the present patent application will be called an L-antenna.

The microstrip antenna consists of a ground plane, a radiating antenna element, as well as a feeding line. In between and above the ground plane and the antenna element, there is either air or some other dielectric agent as an insulating material.

Traditionally, the L-antenna is a whip antenna that is bent near the ground plane parallel to the ground plane, whereupon the antenna has a low feed impedance. It is also possible to build of the L-antenna a microstrip antenna that consists of a ground plane, a radiating antenna element as well as a feeding line.

Normally, the length of the resonant proportion of the antenna in wavelengths is defined as the difference between the microstrip antenna and the L-antenna. The electric length of the microstrip antenna is half a wavelength whereas, traditionally, the electric length of the L-antenna is a quarter of a wavelength. From the electric length of the L-antenna it follows that the maximum current of the L-antenna is at the input.

Normally, the microstrip antenna is made on a double-sided substrate, one metallisation of which acts as the ground plane and on the other, the pattern of the antenna element is made by etching. The antenna element is fed by the feeding line, which is coupled to the antenna element either from one side (FIG. 1*a*) or by taking the feeding line through the ground plane and the insulating material (FIG. 1*b*). The resonance frequency of the microstrip and L-antennas is affected by the physical dimensions of the antenna element, the place of the feeding point, as well as, to some extent, the location of the antenna element with respect to the ground plane.

The size of the microstrip antenna has been reduced by developing a so-called PIFA antenna (PIFA, Planar Inverted F-Antenna), shown in FIG. 2*b*. In the PIFA antenna, the antenna element is coupled to the ground plane by a grounding line. This being the case, the actual antenna element can be dimensioned so that it is considerably smaller than in the case of the microstrip antenna. Furthermore, by optimising the place of the feeding point, the feed impedance of the antenna can be changed to the desired impedance level, which is not possible in the L-antenna. The resonance frequency of the PIFA antenna is affected by the physical dimensions of the antenna element and the ground plane, as well as by the distance of the antenna element from the ground plane. The antenna element is fed either from one side (FIG. 2*a*) or by taking the feeding line through the ground plane and the insulating material (FIG. 2*b*). When narrowing the width of the grounding line, the resonance frequency of the antenna decreases. The grounding line can be as wide as the whole antenna element or, at its narrowest, merely a conductor.

Furthermore, it is well known to feed a microstrip antenna capacitively. In a capacitively fed microstrip antenna, there is a feeding element in between the antenna element and the ground plane, whereupon a capacitive coupling is formed between the antenna element and the feeding element. The feeding line is coupled to the feeding element, which radiates power further to the antenna element. The capacitive coupling can be implemented both in the microstrip antenna (FIG. 3) and the PIFA antenna (FIG. 4).

The problem of microstrip antennas is the narrow bandwidth. The frequency ranges of $2^{nd}$ generation mobile communication systems are reasonably narrow and, therefore, they can be implemented by microstrip antennas. For example, the frequency range of the GSM system is 890–960 MHz, wherein a transmission band is 890–915 MHz and a reception band is 935–960 MHz. Thus, the bandwidth required of one antenna element is no less than 70 MHz. Due to the production tolerances and the objects in the vicinity of the antenna, for example, the hand of a user, the bandwidth of the antenna element must be even wider. The frequency ranges required by $3^{rd}$ generation mobile communication systems, for example, broadband CDMA systems are still considerably wider than, for example, the GSM system's and, therefore, their implementation with microstrip antennas is difficult. For example, a transmission band of the WCDMA system is 1920–1980 MHz and a reception band is 2110–2170 MHz. This being the case, the whole width of the frequency range is 250 MHz. This is why the bandwidth of microstrip antennas according to prior art described above has been increased as far as possible with solutions, where several resonance frequencies close to each other are implemented in one antenna element.

Solutions are known from prior art, where several resonance frequencies close to each other are implemented in one antenna element. In one solution, the number of resonance frequencies is increased by adding slots to the antenna element. However, the slots easily act in the case of small antennas as slot radiators, whereupon antenna elements that are resonating close to each other are strongly coupled to each other and form a resonator around the slot. This further follows that at the frequency in question the radiation resistance is low and the current densities in the vicinity of the slot are high, whereupon the loss of the antenna increases. Consequently, the adding of the bandwidth of a microstrip antenna in the manner in question only succeeds at the cost of gain and radiation efficiency. Hence, with the solution in question, for example, the gain values required by $3^{rd}$ generation broadband CDMA systems cannot be achieved.

Of the microstrip antennas described above, an attempt has also been made to develop antenna structures that operate in several frequency ranges. For example, an antenna structure of two frequency ranges can be implemented by one common feeding point and an antenna element the resonance frequency of which can be adjusted by a switch and an electric load to the frequency range of another mobile communication system. A second alternative is to use one antenna element and two separate feeding points, whereupon two different resonance frequencies are generated in the antenna element. A third alternative is to use two antenna elements, which are coupled to a common feeding point. In this case, both antenna elements have one resonance frequency.

FIG. 5 shows a PIFA antenna of two frequency ranges according to prior art, which is fed from one feeding point. The resonance frequency of the antenna element is adjusted either by coupling in between the antenna element and the ground plane an electric load. Alternatively, the load can also be coupled as part of the feeding line. The load can be some reactive component, for example, a capacitance or inductance. The size of the change in the resonance frequency is determined on the basis of the electric load.

A solution according to FIG. 5 is described, for example, in the publication "Electrical Tuning of Integrated Mobile Phone Antennas," Louhos, J-P, Pankinaho, I, Proceedings of The 1999 Antenna Applications Symposium, Allerton Park, Monticello, Ill., Sep. 15–17, 1999. In the solution in question, it is possible to operate with one PIFA antenna element both on a transmission and reception band of the GSM900 system. The antenna element is dimensioned so that the first resonance frequency is selected from the reception band of the GSM900 system. The resonance frequency is adjusted to a lower resonance frequency by coupling the capacitive load C with a switch S between the antenna element and the ground plane, whereupon the resonance frequency of the antenna element changes to the transmission band of the GSM900 system.

FIGS. 6 and 7 describe the antenna structures described in the publication "Dual Frequency Planar Inverted F-Antenna" (Liu Z., et al., IEEE Transactions on Antennas & Propagation, No. 10, October 1997, pages 1451–1458), wherein two resonance frequencies are implemented in one PIFA antenna.

In the solution according to FIG. 6, from a PIFA antenna E1, a part E2 is separated, which is dimensioned for a higher frequency range. The first antenna element E1 is fed from a feeding point F1 and the second antenna element E2 is fed from a second feeding point F2. Both antenna elements are grounded and dimensioned so that they have different resonance frequencies. For grounding, a plurality of ground pins G1, G2 are used. The antenna elements' polarisations are the same.

In the solution according to FIG. 7, the antenna elements are coupled to each other, whereupon one antenna element E3 is formed, which is fed from one feeding point F3. For grounding, a plurality of ground pins G3, G4, G5 are used. In this case, in one slotted PIFA antenna, two resonance frequencies can be implemented. However, the dimensioning of the antenna elements becomes considerably more difficult, because the antenna elements are coupled to the same feeding point and the antenna elements' gain, impedance and bandwidths depend on each other. Also in this solution, the antenna elements' polarisations are the same.

The advantage of one feeding point compared to solutions of a plurality of feeding points is that the manufacturing of the antenna elements becomes easier and the need for contact surfaces decreases. The required area also becomes smaller. In addition, production, operators and the authorities want to measure the operation of an antenna, as well as the strength and quality of the signal transmitted and received by a mobile phone from one feeding point.

In the case of one feeding point and several antenna elements, the biggest problem is the inter-coupling of the antenna elements, which impairs the radiation efficiency of the antenna structure. Due to the inter-coupling of the antenna elements, from the antenna element that operates at a first frequency range, power is coupled to the antenna element of a second frequency range and vice versa. Therefore, in the solutions of several antenna elements in question, the harmful inter-coupling of antenna elements must be reduced in order to achieve good radiation efficiency.

In the solutions according to prior art described above, the antenna elements are parallel to the ground plane, whereupon the coupling between the antenna elements and the ground plane is highly capacitive. The capacitive coupling in turn follows that the antenna elements are unilateral. The transmitting antennas used in mobile stations should be unilateral, whereas their receiving antennas should be as isotropic, i.e. omnidirectional as possible. For example, the antenna structure according to FIG. 5 operates well when information is transmitted from a mobile station to a base transceiver station, but information transmitted by the base transceiver station should be received in all the different operating positions of the phone.

Although, in the solutions mentioned above, it is possible to change from one frequency range into another, the solutions are implemented in the GSM system, i.e. with reasonably narrow bandwidths. In addition, the antenna elements are unilateral, whereupon they do not necessarily operate sufficiently well when receiving a broadband signal. On the other hand, the problem with the antenna structure of two antenna elements fed from one feeding point is, in addition to those mentioned above, also the inter-coupling of the antenna elements. Hence, it has not been possible to implement antenna solutions required by $3^{rd}$ generation mobile stations that meet the gain, radiation efficiency and bandwidth values, by microstrip antennas according to prior art.

Due to the factors mentioned above, by microstrip antennas according to prior art, it has neither been possible to implement an antenna structure comprising one feeding point that would operate optimally enough in both $2^{nd}$ and $3^{rd}$ generation mobile stations.

SUMMARY OF THE INVENTION

In the present invention, an antenna structure fed from one feeding point that operates on several different frequency bands with which in addition to a good bandwidth also unilaterality in transmitting and isotropy in receiving is achieved, is implemented in a new way. The antenna structure's gain and radiation efficiency are made good by reducing the interfering inter-coupling of the antenna elements. In addition, due to the positioning of the antenna elements, the space required by the whole antenna structure is smaller compared to the antennas of a corresponding frequency range. Consequently, it is easy to position an antenna structure according to the invention, for example, inside a mobile phone or an antenna unit to be coupled to a mobile phone.

The objectives of the invention are achieved by both a new frequency band solution and a new positioning of antenna elements, which enables the implementation of an antenna structure that operates on a broad band. In the frequency band solution, the antenna's transmitting antenna element of a lower frequency range is more unilateral than the receiving antenna element of a higher frequency range. In addition, the positioning of antenna elements according to the invention reduces the inter-coupling between at least two antenna elements, whereupon the antenna structure's gain and radiation efficiency become good.

The basic idea of the invention is to use, instead on one transmitting and receiving antenna element, two antenna elements coupled to each other with a coupling line so that a first antenna element is used to receive information from a reception band of a first radio system and a second antenna element is used to transmit information on a transmission band of the first radio system. In a preferred embodiment of the invention, the first reception band is a reception band of some broadband CDMA system of a $3^{rd}$ mobile station generation and the first transmission band is a transmission band of the same broadband CDMA system. In this way, the antenna structure is made to operate on a broad band and it is possible to operate in a broad frequency range.

According to the invention, the antenna elements are positioned so that the first antenna element, which preferably is a receiving antenna element, is on the side of the ground plane and perpendicular to the ground plane and the second antenna element, which preferably is a transmitting antenna element, is in turn above the ground plane and parallel to the ground plane. This being the case, the first antenna element can be made omnidirectional and the second antenna element unilateral. There is also little harmful inter-coupling between the antenna elements, whereupon a good gain and radiation efficiency are achieved by the antenna structure.

Harmful inter-coupling can be further reduced by designing the polarisations of the first and second antenna elements to differ from each other, whereupon a good polarisation attenuation is produced between the antenna elements.

By improving the coupling between the resonances of the first antenna and the ground plane, the efficiency and omnidirectionality of the antenna can be improved on the reception band. This can be best implemented so that the open end of the first antenna element is located in the vicinity of the upper edge of the printed board, whereupon the electric fields of the antenna and the ground plane are strongly coupled to each other at the "open" end of both radiators. This being the case, the antenna element acts as a feeding element for the ground plane, which acts as a main radiator.

The coupling between the second antenna element and the ground plane can again be reduced by placing the second antenna element on the ground plane so that the open end, feeding point and ground point of the second antenna element are located more in the centre of the ground plane. In this case, according to a preferred embodiment, the antenna structure can be placed in a mobile station that has, for example, a camera and a GPS antenna.

In the preferred solution, the adaptation of the first antenna element can be improved further by designing a coupling line connecting the antenna elements from the input to the second antenna element and a grounding line reaching from the second antenna element to the ground so that their common electric length is a quarter of a wavelength at the resonance frequency of the first antenna. This being the case, the first antenna element sees the grounding in question as open and the antenna operates more efficiently as a monopole-type (e.g. folded monopole) antenna. This also follows that although the grounding line of the first antenna element is slightly shorter than a quarter of a wavelength, its effect is smaller on the adaptation of the first antenna element than on the adaptation of the second antenna element and, thus, the capacitance of the first antenna element with respect to the ground plane is lower in the optimum location of the first antenna element so that radiation resistance and feed impedance of the first antenna element are sufficiently high.

The suitability of the antenna solution according to the invention for end products can be further improved with a preferred embodiment according to the invention, wherein the second antenna element is arranged to also operate in the frequency range or part of the frequency range of a second mobile communication system. In this case, for example, an antenna structure can be implemented, wherein by the first antenna element a reception band of a broadband radio system is implemented. By the second antenna element, both a transmission band of a broadband radio system and at least one transmission band of a second radio system, which is e.g. a transmission band, a reception band or both of the GSM1800 or GSMA1900 system, are implemented.

There always remains a little harmful, lossy inter-coupling between the antenna elements, which makes it more difficult to implement the second antenna element as adjustable. In the case in question, however, the implementation of the second antenna element becomes easier due to the first antenna element, because the first antenna element improves slightly the adaptation of the second antenna element at a lower resonance frequency on said frequency band of the GSM1800 or GSMA1900 systems and, thus, simultaneously adds to said bandwidth. Consequently, by the antenna structure according the invention, it is possible to implement an antenna structure that operates both in $2^{nd}$ and $3^{rd}$ generation mobile communication systems.

In the antenna structure according to the invention, the antenna elements do not significantly impair each other's properties, whereupon it is easy to add to the same feeding point antenna elements that operate below and above the first transmission band. Thus, the operation of the antenna structure according to the invention can be extended, for example, into the frequency ranges of the GSM900 or PDC800 systems by using antenna elements dimensioned for the frequency ranges in question. The adding of antenna elements that operate above the first frequency range is even easier, because as the frequencies increase, the size of the antenna elements becomes smaller. It is easy to implement in the antenna structure, for example, at least one of the antenna elements of the following systems: Bluetooth, WLAN (Wireless Local Area Network) or GPS (Global Positioning System).

According to a first aspect of the invention, there is implemented an antenna structure, which comprises a first antenna element, a second antenna element, a ground plane for grounding the antenna structure, a coupling line for coupling the first antenna element and the second antenna element to each other, and a feeding line for feeding the antenna structure through one feeding point, in which antenna element (=antenna structure!), the first antenna element is next to the ground plane and perpendicular to the ground plane and the second antenna element is above the ground plane and parallel to the ground plane.

According to a second aspect of the invention, there is implemented a method for coupling a signal to an antenna structure, which comprises a first antenna element, a second antenna element, a ground plane for grounding the antenna structure, a coupling line for coupling the first antenna element and the second antenna element to each other, a feeding line for feeding the antenna structure, and which method comprises coupling signals to be transmitted and received to the antenna structure through one feeding point, the method comprising positioning the first antenna element next to the ground plane and perpendicular to the ground plane and positioning the second antenna element above the ground plane parallel to the ground plane.

According to a third aspect of the invention, there is implemented an antenna unit, which comprises an antenna structure, which antenna structure comprises a first antenna element, a second antenna element, a ground plane for grounding the antenna structure, a coupling line for coupling the first antenna element and the second antenna element to each other, and a feeding line for feeding the antenna structure through one feeding point, and which antenna structure is manufactured on an insulating material which has a base and at least one wall region, which wall region reaches in a direction deviating from the base, and the shape of which antenna structure follows the shapes of the base and the wall region, and in which antenna structure the first antenna element is next to the ground plane and perpendicular to the ground plane and the second antenna element is above the ground plane and parallel to the ground plane.

According to fourth aspect of the invention, there is implemented a mobile station, which comprises an antenna structure, which antenna structure comprises a first antenna element, a second antenna element, a ground plane for grounding the antenna structure, a coupling line for coupling the first antenna element and the second antenna element to each other, and a feeding line for feeding the antenna structure through one feeding point, and in which antenna structure the first antenna element is next to the ground plane and perpendicular to the ground plane and the second antenna element is above the ground plane and parallel to the ground plane.

LIST OF THE DRAWINGS

In the following, the invention will be described in detail by referring to the enclosed drawings, in which FIG. 1*a* shows a microstrip antenna according to prior art, which is fed from one side;

FIG. 1*b* shows an L-antenna according to prior art, which is fed through a ground plane and an insulating material;

FIG. 2*a* shows a PIFA antenna according to prior art, which is fed from one side;

FIG. 2*b* shows a PIFA antenna according to prior art, which is fed through a ground plane and an insulating material;

FIG. 3 shows a capacitively fed microstrip antenna;

FIG. 4 shows a capacitively fed PIFA antenna;

FIG. 5 shows a PIFA antenna according to prior art, the resonance frequency of which is adjustable;

FIG. 6 shows a PIFA antenna according to prior art, which operates in two frequency ranges and comprises two separate feeding points;

FIG. 7 shows a PIFA antenna according to prior art, which operates in two frequency ranges and comprises one feeding point;

Figure 8A:
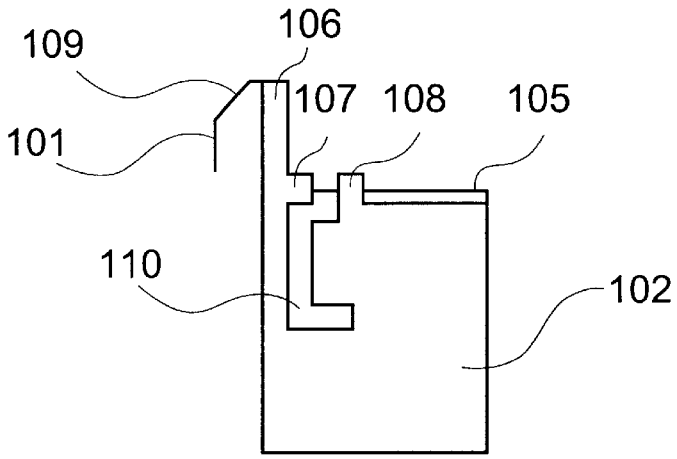
Figure 8B:
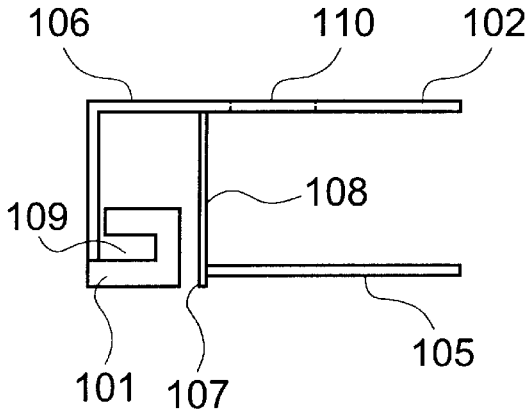
Figure 8C:
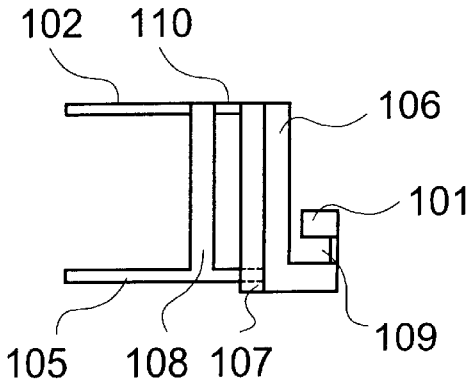
Figure 9:
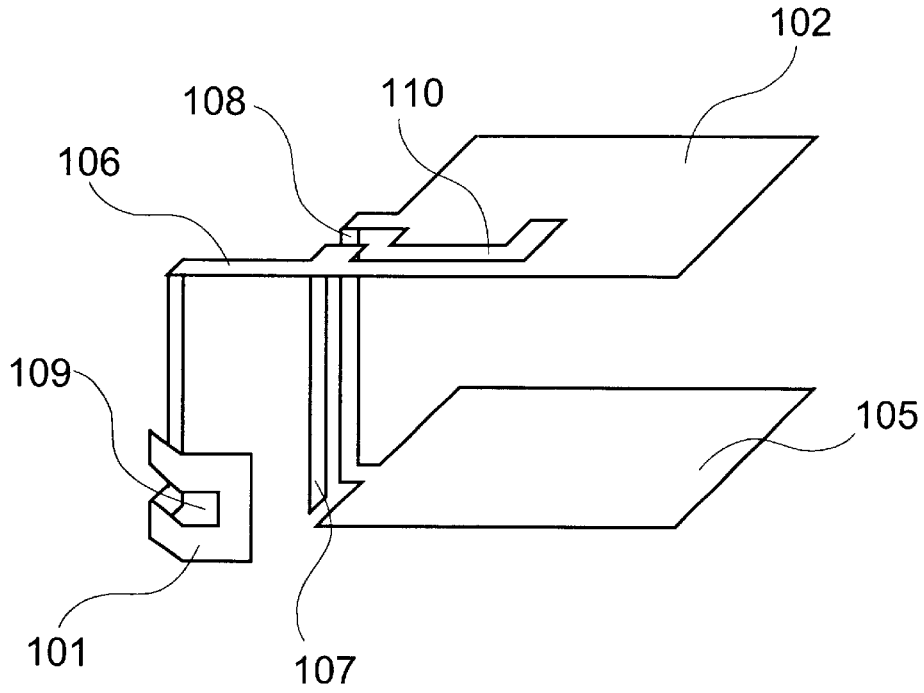
Figure 10:
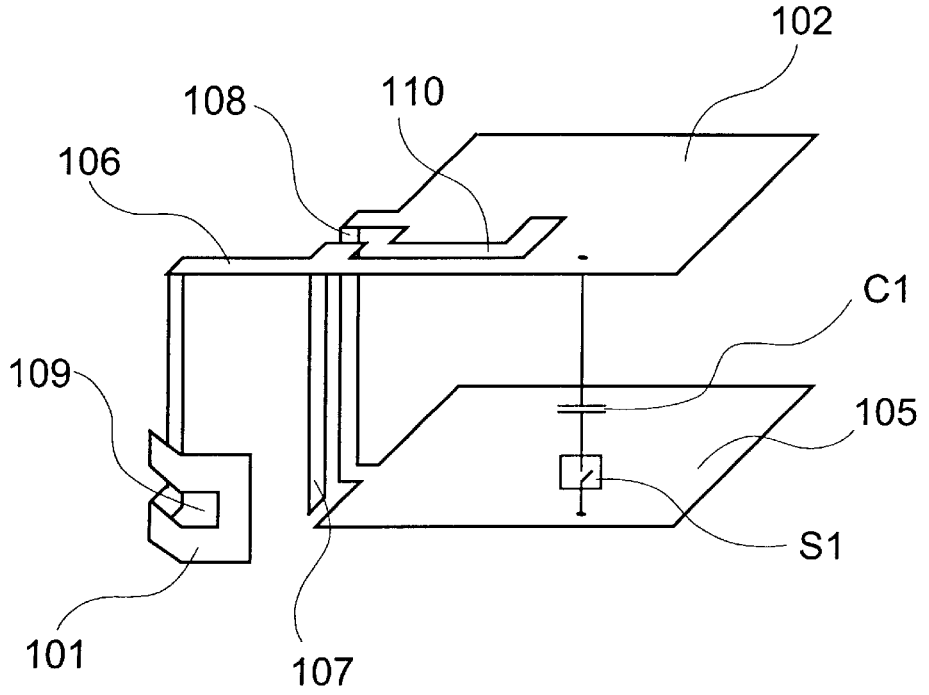
Figure 11:
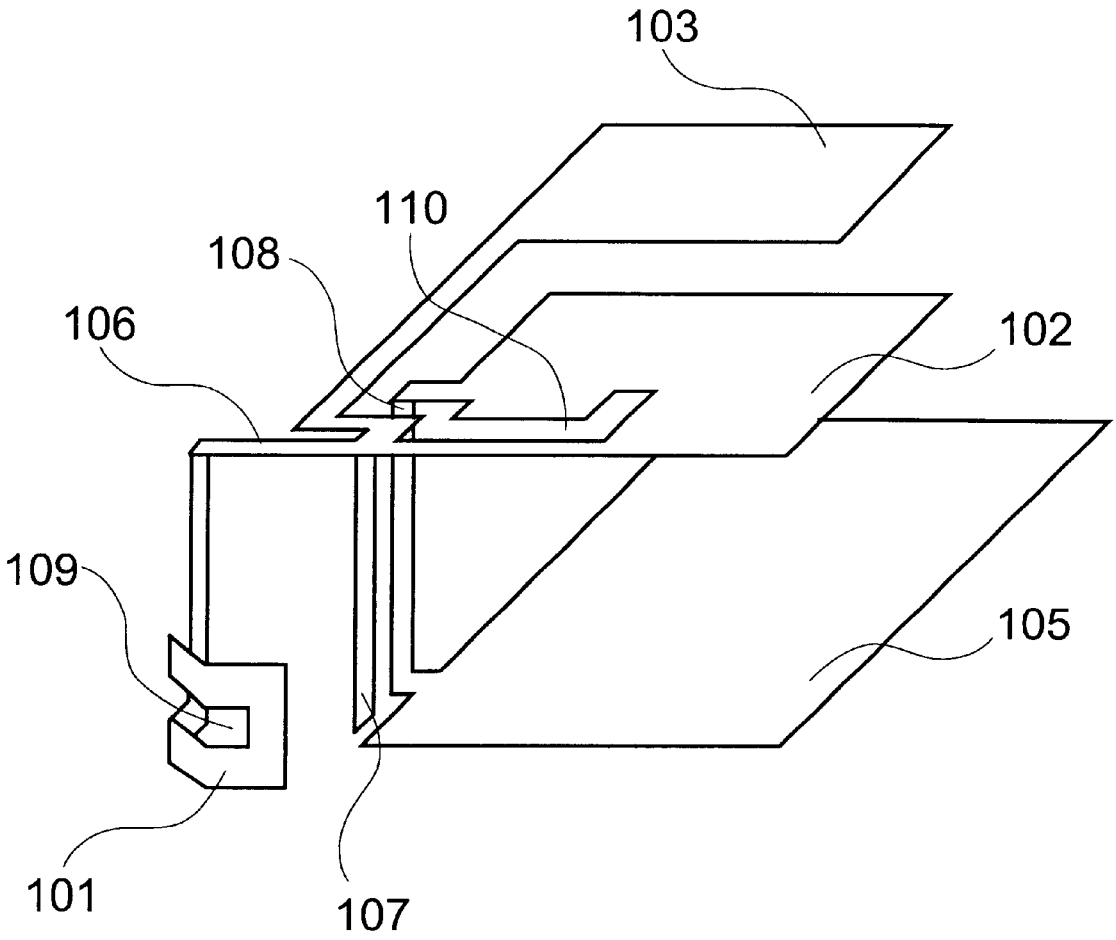
Figure 12:
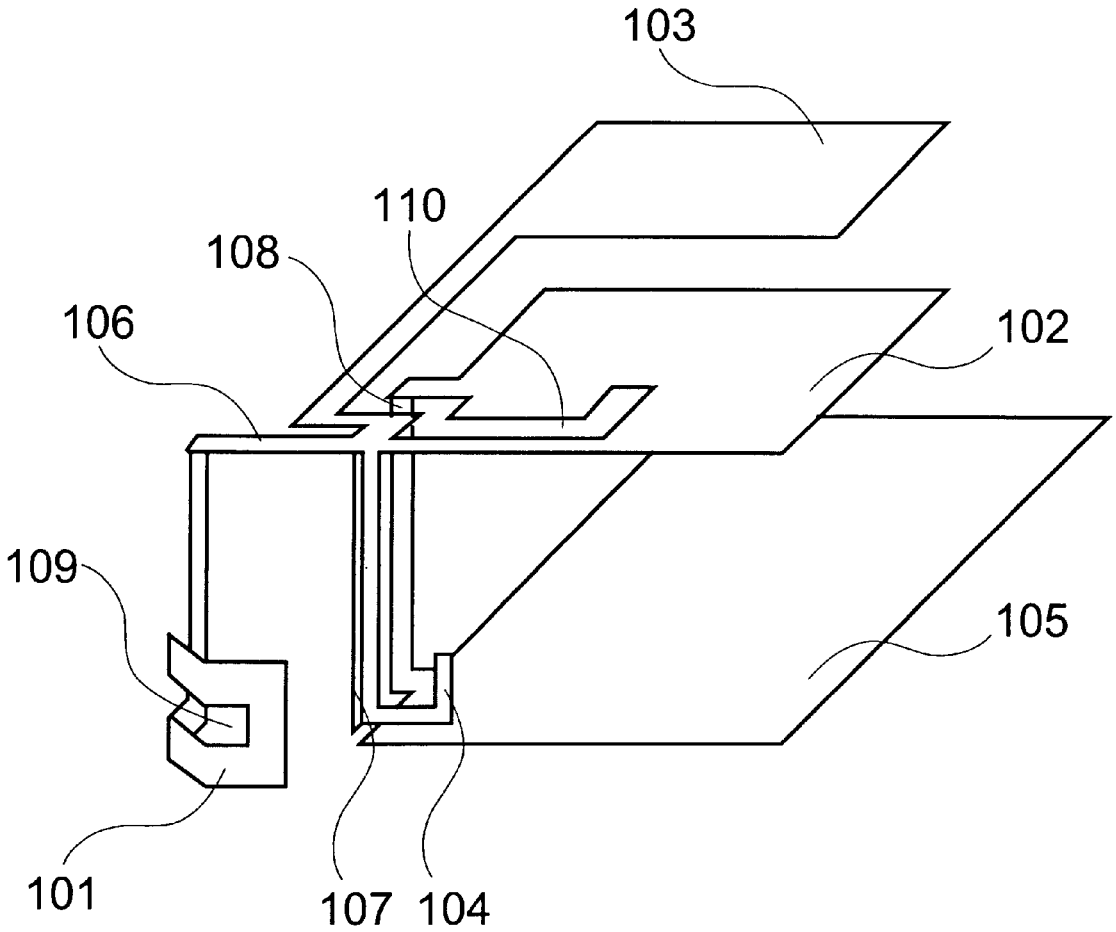
Figure 13:
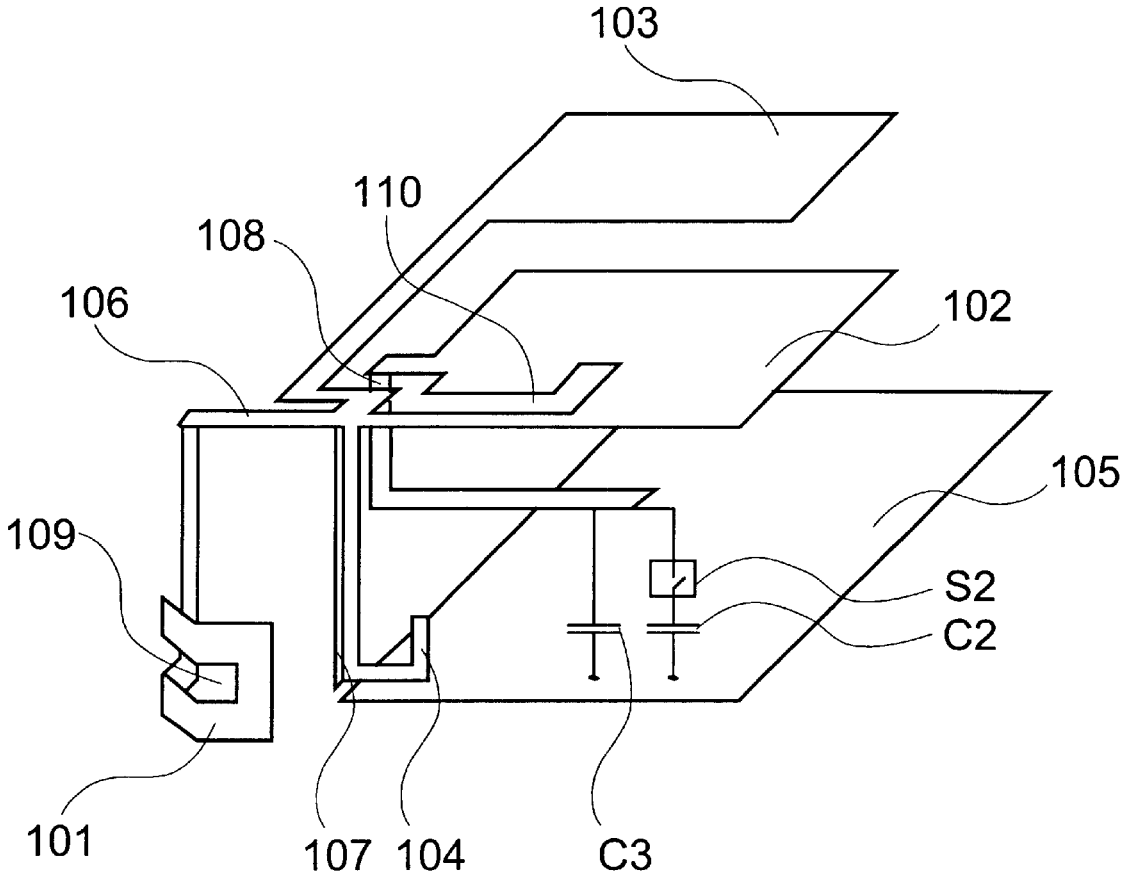
Figure 14:
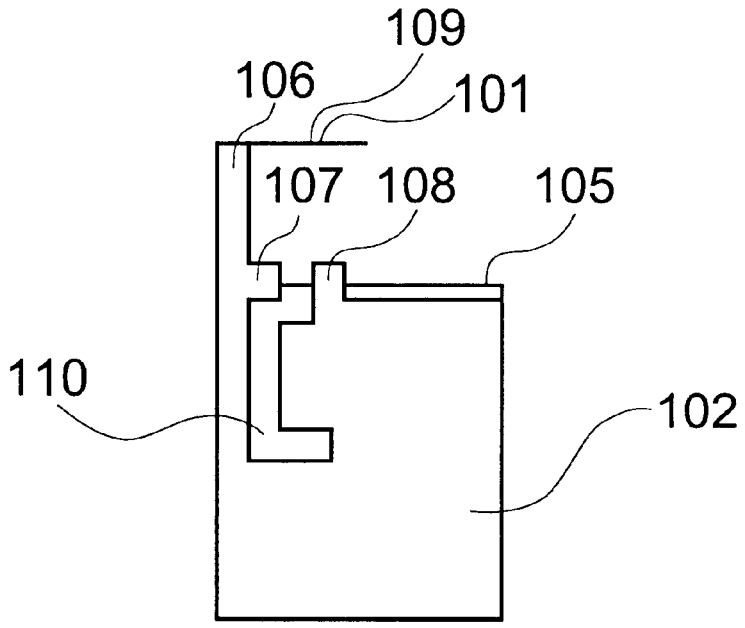
Figure 15:
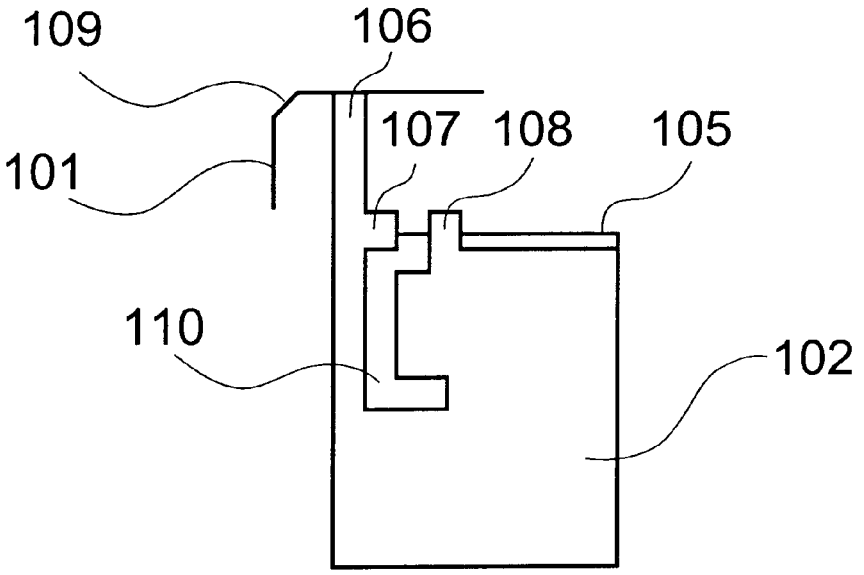
Figure 16A:
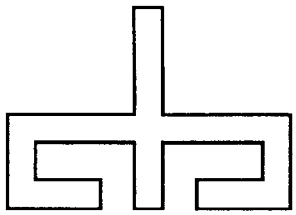
Figure 16B:
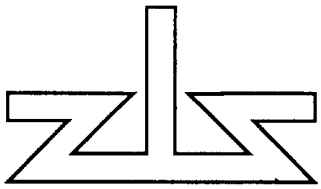
Figure 16C:
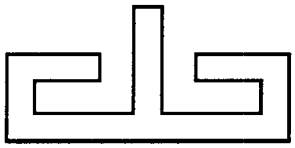
Figure 16D:
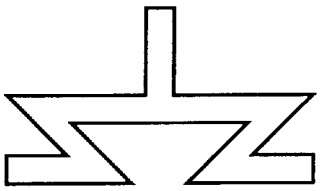
Figure 17:
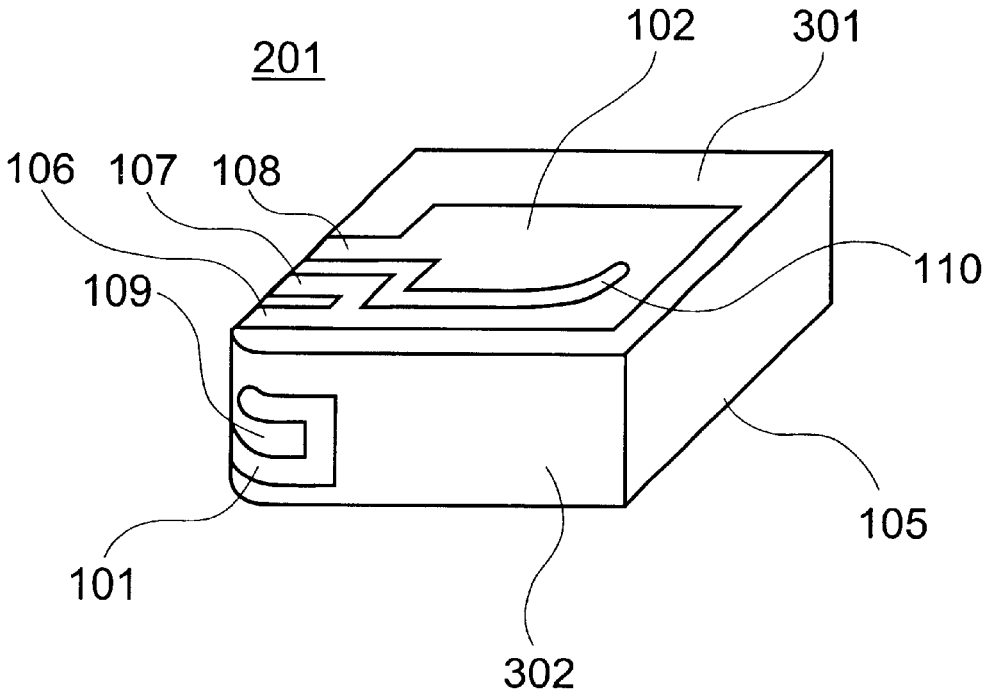
Figure 18:
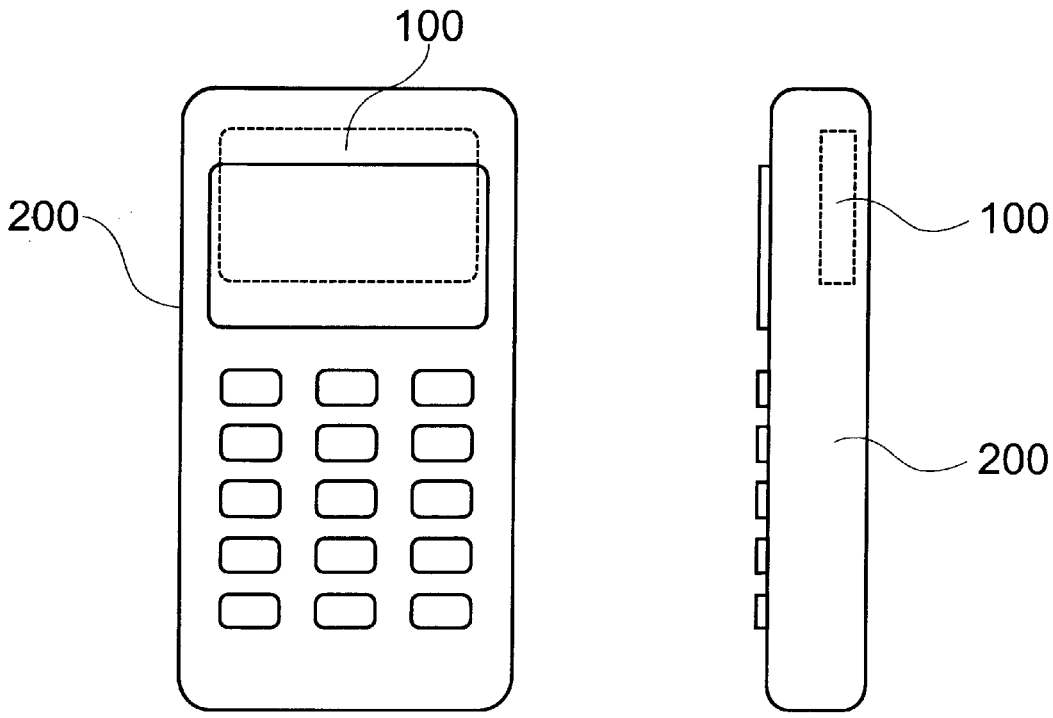

FIG. 8*a* shows an antenna structure according to the invention viewed from above;

FIG. 8*b* shows an antenna structure according to the invention viewed from one side;

FIG. 8*c* shows an antenna structure according to the invention viewed from the front;

FIG. 9 shows an antenna structure according to the invention three-dimensional FIG. 10 shows a preferred embodiment;

FIG. 11 shows a preferred embodiment;

FIG. 12 shows a preferred embodiment;

FIG. 13 shows a preferred embodiment;

FIG. 14 shows a preferred embodiment;

FIG. 15 shows a preferred embodiment;

FIG. 16*a* shows a preferred embodiment of a T-element;

FIG. 16*b* shows a preferred embodiment of a T-element;

FIG. 16*c* shows a preferred embodiment of a T-element;

FIG. 16*d* shows a preferred embodiment of a T-element;

FIG. 17 shows an antenna unit;

FIG. 18 shows a mobile station;

FIG. 19 shows a preferred embodiment.

DETAILED DESCRIPTION OF THE INVENTION

The figures to be presented in the following are exemplary and only include the parts necessary for the understanding of the operating principle of an antenna structure 100. Of the same parts, the same reference numbers are used in FIGS. 8–19.

FIGS. 8*a*, 8*b* and 8*c* show the antenna structure 100 according to the invention viewed from above, from one side and from the front respectively. FIG. 9 in turn shows the antenna structure 100 according to the invention three-dimensionally.

The antenna structure 100 consists of a first antenna element 101, a second antenna element 102, a ground plane 105, a coupling line 106 that connects the antenna elements, a feeding line 107 and a grounding line 108, which is coupled from the second antenna element 102 to the ground plane 105. Further, the first antenna element 101 comprises a first tuning slot 109 and the second antenna element comprises a second tuning slot 110.

Thus, the antenna structure according to the invention consists of a microstrip antenna and a PIFA antenna coupled to each other with the feeding line of the L-antenna. The feeding point of the antenna structure is on the connection of the feeding line of the microstrip antenna and the PIFA antenna or in the immediate vicinity of the connection. The microstrip antenna and the PIFA antenna also have tuning slots. The coupling line 106, the feeding line 107 and the grounding line 108 are preferably microstrips, but other conductors known to a person skilled in the art can also be used.

The second antenna element 102 is a quadrangular plane, parallel to the ground plane. From the corner formed by a first and second side of the plane, there starts the coupling line 106 that continues away from the second antenna element 102 and bends towards the ground plane 105 so that it substantially deviates from the plane of the second antenna element 102. The coupling line 106 is reasonably narrow compared to the lengths of the sides of the second antenna element 102. The length of the coupling line depends on the electric lengths of the desired resonance frequency.

The first antenna element 101 is at the end of the coupling line 106 and perpendicular to the ground plane. The first antenna element 101 is a quadrangular plane, which has two shorter and two longer sides. The first antenna element 101 starts from the end of the coupling line 106 so that the longer sides are parallel to the ground plane 105 and the shorter sides are perpendicular to the ground plane 105. The first antenna element 101 bends towards the second antenna element 102, parallel to the first side of the second antenna element 102.

By the first antenna element, the upper part of the frequency range of a broadband radio system (e.g. a reception band of the WCDMA system) is implemented and by the second antenna element, the lower part of a broadband radio system (e.g. a transmission band of the WCDMA system) is implemented. The sides of the first antenna element 101 are shorter than the sides of the second antenna element 102, whereupon the first antenna element 101 operates on a shorter wavelength, i.e. at a higher resonance frequency. Consequently, the area of the first antenna element 101 is smaller than the area of the second antenna element 102. In addition, the first antenna element is coupled to the ground plane 105 less capacitively than the second antenna element 102.

For reducing inter-coupling, the polarisations of the antenna elements can be designed to differ from each other. The first antenna element 101 is, for example, elliptically polarised and the second antenna element 102 more linearly polarised. correspondingly, depending on the positioning of an antenna element in a mobile station, the second antenna element 102 can be elliptically polarised and the first antenna element 101 more linearly polarised. Linear polarisations that differ from each other can also be used. In this case, one of the antenna elements is, for example, horizontally and the other is vertically polarised.

The polarisation of the antenna elements can be affected by positioning the antenna elements in directions that deviate from each other with respect to the ground plane. The place of the feeding point of the antenna elements with respect to the second antenna element also influences the polarisation of which antenna element is primarily affected by the ground plane.

The antenna structure 100 is fed from the corner formed by the feeding line 106 and the second side of the second antenna element 102 or from its immediate vicinity. The feeding line 107 is coupled to at least one of the following: either to the coupling line 106 or to the second antenna element 102. The feeding line 107 deviates from the plane of the second antenna element 102 and bends towards the ground plane 105.

To the end of the feeding line 107, for example, a transceiver is coupled. A transmitted signal is coupled from the transceiver to the end of the feeding line 107, from where the power of the transmitted signal is further coupled through the feeding line 107 to the antenna structure 100. When receiving, the power of the received signal is coupled to the antenna structure 100, from where the power of the received signal is coupled through the feeding line 107 to the end of the feeding line 107 and further to the transceiver. At the feeding point, a peak value of the current distribution of the antenna structure is generated at the resonance frequency of the first antenna element 101, whereupon the current distribution of the antenna structure and further the resonance frequency, the feed impedance and the radiation pattern are affected by the positioning and dimensioning of the feeding line.

From the second side of the second antenna element 102, there starts the grounding line 108, which is coupled to the ground plane 105. At the resonance frequency of the second antenna element 102, a peak value of the current distribution is generated in the grounding line. The location of the grounding line influences in particular the current distribution, the ellipticity of polarisation, the optimisation of adaptation and the resonance frequency of the second antenna element 102.

Due to the tuning slots, the first and second antenna elements can be dimensioned to be smaller than without the tuning slots. This is done by dimensioning, positioning and shaping the tuning slots in the antenna element according to the gain, bandwidth and radiation efficiency values required of the antenna structure. The function of the tuning slots is also to adapt the resonance frequencies of the antenna elements 101, 102 and the antenna structure 100, for example, to 50 ohms.

The first tuning slot 109 starts from the side of the contact point of the first antenna element 101 and the coupling line 106 and it continues to the first antenna element 101. The first tuning slot 109 starts parallel to the shorter sides of the first antenna element 101 and turns away from the coupling line 106 becoming parallel to the longer sides of the first antenna element 101.

The second tuning slot 110 starts from the second side of the second antenna element 102, from between the feeding line 107 and the grounding line 108, and it continues to the second antenna element 102.

The second tuning slot 110 goes from the second side of the second antenna element 102 towards the first side of the second antenna element 102, turns parallel to the first side and further away from the first side.

The longer sides of the first antenna element 101 are about 11 mm and the shorter ones are about 6 mm. All the sides of the second antenna element 102 are about 18 mm. The length of the first tuning slot is about 11 mm and the width is about 1.5 mm. The length of the second tuning slot is about 17 mm and the width is about 1.5 mm. This being the case, the antenna structure is dimensioned for the WCDMA system's frequency range of 1920–2170 MHz, by the first antenna element, information coming from a base transceiver station is received on a first reception band, at frequencies of 2110–2170 MHz, and by the second antenna element, information is transmitted to a base transceiver station on a first transmission band, at frequencies of 1920–1980 MHz. The resonance frequency of the first antenna element is above the first reception band, at a frequency of 2200 MHz, and the resonance frequency of the second antenna element is below the first transmission band, at a frequency of 1750 MHz. In this case, with the solution in question, in addition to the WCDMA system's transmission band, also a bandwidth of 1710–1990 MHz is achieved, for example, for one of the following systems: GSM1800, GSMA1900, TDMA1900, CDMA1900.

The distance of the antenna structure 100 from the ground plane 105 influences to some extent the resonance frequencies of the first 101 and second antenna element 102. The distance of the second antenna element 102 from the ground plane 105 is approximately 7 mm. The first antenna element 101 in turn is positioned next to the edge of the ground plane, perpendicular to the ground plane 105 according to FIG. 8*b*. The distance of the first antenna element 101 from the edge of the ground plane 105 is approximately 5 mm and its lower edge is at a height of about 3 mm from the ground plane 105. By moving the first antenna element 101 with respect to the ground plane, the inter-coupling of the antenna elements is influenced, which decreases as the distance between the antenna elements increases.

By implementing an antenna structure according to the invention in the manner described above, inter-coupling between the antenna elements 101, 102 can be made little, the losses of the antenna structure 100 sufficiently small and the gain sufficiently high on the required bandwidth. Furthermore, the transmitting second antenna element 102 can be made unilateral and the receiving first antenna element 101 omnidirectional, whereupon the antenna structure 100 operates well, for example, on transmission and reception bands of different mobile communication systems. An advantage is further achieved, in addition to those mentioned above, by positioning the first antenna element 101 on one side of the antenna structure 100 so that the antenna structure can still be easily positioned in a mobile station.

By improving the coupling between the resonances of the antenna element 101 and the ground plane 105, which is connected to a ground plane 105' of a mobile station 200, it is possible to improve the efficiency and omnidirectionality of the antenna. With reference to FIG. 19, this can be best implemented so that the open end of the antenna element 101 is located in the vicinity of the upper edge U of the ground plane 105' of the mobile station 200, whereupon the electric fields of the antenna and the ground plane are strongly coupled to each other at the "open" end of both radiators. This being the case, the antenna element 101 acts as the feeding element for the ground plane 105', which acts as the main radiator.

The coupling between the resonances of the second antenna element 102 and the ground plane 105' can again be reduced by placing the antenna element 102 on the ground plane so that the open end, the feeding point and the ground point of the antenna element 102 are located more in the centre of the ground plane 105' (at point M). This is shown in the preferred embodiment according to FIG. 19.

The coupling between the antenna elements 101 and 102 can be reduced and the efficiency and adaptation of the antenna element 101 can be further improved by designing the coupling line 106 connecting the antenna elements from the input to the second antenna element 102, as well as the grounding line 108 that reaches from the second antenna element to the ground so that their common electric length is a quarter of a wavelength at the resonance frequency of the first antenna 101. In this case, the antenna element 101 sees the grounding line 108 as open and it will not affect the operation of the antenna 101. This also follows that although the grounding line (of) the antenna element 101 is slightly shorter than a quarter of a wavelength, its effect is smaller on the adaptation of the antenna element 101 than on the adaptation of the antenna element 102 and, thus, the capacitance of the antenna element 101 with respect to the ground plane should be and indeed is in an optimum location lower so that the radiation resistance and feed impedance of the antenna element 101 are sufficiently high. The adaptation measured from the feeding point at the resonance frequency of the first antenna element 101 and the second antenna element 102 should be, for example, approximately 50 ohm.

The first antenna element 101 and the second antenna element 102 can also be fed by capacitive feed in a manner well known to a person skilled in the art. This is achieved by coupling behind the antenna element an element that feeds it. The feeding element in turn is coupled to the feeding line. The feeding element is dimensioned so that its electric length is equal to the electric length of the antenna element FIG. 10 illustrates a preferred embodiment, wherein the operation of the antenna structure 100 according to the invention is further improved so that the second antenna element 102 is arranged to operate on at least one frequency band of a second radio system. In this way, an antenna structure can be implemented, wherein by the first antenna element 101, it is received, for example, on a reception band of some broadband CDMA system, and by the second antenna element 102, it is both transmitted on a transmission band of the broadband CDMA system and transmitted and/or received on at least one frequency band of the second radio system. The frequency band of the second radio system can be, for example, a transmission band, a reception band or both in the frequency range of some $2^{nd}$ generation mobile communication system.

A first capacitive load C1 is coupled to the second antenna element 102. The load C1 is further coupled by a first switch S1 to the ground plane 105 so that the resonance frequency of the second antenna element 102 can be adjusted for at least one frequency band of the second radio system. The coupling and the first capacitive load can be dimensioned in a manner well known to a person skilled in the art so that when the first switch S1 is open, the second antenna element 102 operates on a transmission band and when the first switch S1 is closed, on at least one frequency band of the second radio system.

The coupling can be arranged so that the resonance frequency of the second antenna element 102 can be adjusted, for example, for a transmission band, a reception band or between the bands of the GSM1800 or GSMA1900 system. In this case, it is possible to operate either on the reception band, the transmission band or in the whole frequency range of the GSM1800 or GSMA1900 system, and space is saved, because no separate antenna element is required for the GSM1800 or GSMA1900 systems. Conventional semiconductor switches, such as FET switches, PIN diodes or similar switches can be used as the first switch S1. In the future, it is possible to use, for example, so-called MEMS (Micro Electro Mechanical System) switches.

FIG. 11 shows a preferred embodiment of the invention. Because, in the antenna structure 100 implemented according to the invention, there is little mutual influence between the antenna elements, it is easy to add to the antenna structure antenna elements that operate below or above the first frequency range. By adding to the antenna structure 100 a third antenna element 103 and by extending the ground plane 105 when necessary, the operation of the antenna structure 100 according to the invention can be extended to at least one frequency band of a third radio system. The third antenna element 103 can be dimensioned in a manner well known to a person skilled in the art so that its resonance frequency is, for example, on a transmission band, a reception band or between the bands of the GSM 900 system. In this case, it is possible to operate with the third antenna element 103 respectively either on the transmission band, the reception band or in the whole frequency range of the GSM900 system. The third antenna element 103 is coupled to the feeding point. In FIG. 11, the third antenna element 103 is coupled to the feeding line 107. The third antenna element 103 can also be coupled to the feeding point, for example, through both the second antenna element 102 and the grounding line 108. The third antenna element is positioned, for example, next to the second antenna element 102 and in the same plane as the second antenna element 102.

It is easy to add antenna elements that operate above the first frequency range, because as the frequencies increase, the size of the antenna elements in question decrease and their positioning is easy. This preferred embodiment is shown in FIG. 12. In the figure in question, a fourth antenna element 104 has been added to the feeding point. By the fourth antenna element 104, at least one frequency band of a fifth radio system is implemented. The fifth radio system can be either a mobile communication system or at least one of the following systems: Bluetooth, WLAN (Wireless Local Area Network) or GPS (Global Positioning System).

The third antenna element 103 can be made adjustable according to a preferred embodiment, which is shown in FIG. 13. In FIG. 13, the third antenna element 103 is adjustable for at least one frequency band of a fourth radio system. In FIG. 13, a second switch S2 and a third capacitive load C3 are coupled to the grounding line 108. The second capacitive load C2 is further coupled from the second switch S2 to the ground plane 105. The third capacitive load in turn is directly coupled from the grounding line to the ground plane 105. The coupling is normally dimensioned so that the resonance frequency of the antenna element decreases as the switch S2 closes. In this case, when the second switch S2 is open, the third antenna element 103 operates on the frequency range of the third radio system and when the second switch S2 is closed, the third antenna element 103 operates on the frequency range of the fourth radio system. Consequently, space is saved and same advantages are achieved as in the case of the second antenna element 102 implemented as adjustable.

The third antenna element 103 can be dimensioned in a manner known to a person skilled in the art so that its resonance frequency is, for example, on a transmission band, a reception or between the bands of the PDC800 system. This being the case, with the third antenna element 103 it is possible to operate respectively either on the transmission band, the reception band or in the whole frequency range of the PDC800 system.

Also the fourth antenna element 104 can be made adjustable for at least one frequency band of a sixth radio system. This is done by electric loads C2, C3 and the switch S2 as in the case of the third antenna element 103. Conventional semiconductor switches, such as FET switches, PIN diodes or corresponding switches can be used as the switch S2. In the future, also the MEMS switches mentioned earlier.

According to FIG. 13, the current and future systems can be implemented in the same feeding point at the frequency ranges of 1500–1600 MHz, 1700–1990 MHz, 2120–2170 MHz, 2400–2500 MHz, 810–960 MHz, depending on the application. If a sufficient frequency band is not achieved without the switch S3, the second load C2 and the third load C3, these can be used for implementing the required bandwidth.

In a preferred embodiment according to FIG. 14, the first antenna element bends parallel to the second side of the second antenna element.

In a preferred embodiment according to FIG. 15, a so-called T-antenna is used as the first antenna element. The T-antenna can be shaped, for example, in the ways shown in FIGS. 16*a,* 16*b,* 16*c* or 16*d.*

In FIG. 17, there is an antenna unit 201 to be placed in a mobile station 200. The figure is given by way of example and it illustrates how the antenna structure 100 can be shaped. The antenna unit 201 comprises the antenna structure 100 according to the invention, which is manufactured on an insulating material. The antenna elements 101, 102, 103 and 104 can be, for example, folded and bent at the design stage, whereupon the antenna structure 100 can be shaped so that it adapts to the shapes of the mobile station. The insulating material has a base 301 and at least one wall region 302, which wall region 302 reaches in a direction deviating from the base 301. The shape of the antenna structure 100 follows the shapes of the base 301 and the wall region 302. The base 301 and the wall region 302 in turn are preferably shaped so that they imitate the shapes of the mobile station 200. The antenna unit 201 can also be protected, for example, by a plastic coating or a corresponding insulating material.

FIG. 18 shows a mobile station 200 that comprises the antenna structure 100 according to the invention. The representation is exemplary and illustrates a preferred positioning of the antenna structure 100 in the mobile station 200. The antenna structure can be integrated inside the mobile station 200 or it can be integrated into an antenna unit to be connected to the mobile station. The antenna structure can be positioned, for example, in the upper part of the mobile station so that the first antenna element 101 is positioned in a corner of the mobile station 200.

This paper presents the implementation and embodiments of the present invention, with the help of examples. A person skilled in the art will appreciate that the present invention is not restricted to details of the embodiments presented above, and that the invention can also be implemented in another form without deviating from the characteristics of the invention. The embodiments presented above should be considered illustrative, but not restricting. Thus, the possibilities of implementing and using the invention are only restricted by the enclosed claims. Consequently, the various options of implementing the invention as determined by the claims, including the equivalent implementations, also belong to the scope of the invention.

I claim:

1. An antenna structure, which comprises a first antenna element for receiving or transmitting information, a second antenna element for receiving or transmitting information, a ground plane for grounding the antenna structure, a coupling line for coupling the first antenna element and the second antenna element to each other, and a feeding line for feeding the antenna structure through one feeding point, wherein the first antenna element is a microstrip antenna and is located next to the ground plane and perpendicular to the ground plane; and the second antenna element is a microstrip antenna and is located on the ground plane and parallel to the ground plane.

2. The antenna structure according to claim 1, wherein the first antenna element is arranged to receive information on a reception band of a broadband radio system and the second antenna element is arranged to transmit information on a transmission band of said broadband radio system.

3. The antenna structure according to claim 1, wherein the polarisation of the first antenna element differs from the polarisation of the second antenna element.

4. The antenna structure according to claim 1, wherein the first antenna element and a coupling line form from the coupling line towards the first antenna element a capacitive load on a transmission band of a broadband radio system, as well as in the frequency range between the transmission and reception bands and also the second antenna element and the coupling line form from the coupling line towards the second antenna element a capacitive load on a reception band of a broadband radio system, as well as in the frequency range between the transmission and reception bands.

5. The antenna structure according to claim 1, wherein the feeding line is coupled to the connection point of the coupling line and the second antenna element.

6. The antenna structure according to claim 1, wherein the antenna structure comprises at least one grounding line for coupling the second antenna element to the ground plane.

7. The antenna structure according to claim 6, wherein the coupling line and the grounding line are dimensioned so that their common electric length is a quarter of a wavelength at the resonance frequency of the first antenna.

8. The antenna structure according to claim 1, wherein the first antenna element comprises at least one first tuning slot for determining the resonance frequency of the first antenna element and for adapting the antenna structure.

9. The antenna structure according to claim 1, wherein the second antenna element comprises at least one second tuning slot for determining the resonance frequency of the second antenna element and for adapting the antenna structure.

10. The antenna structure according to claim 1, wherein the second antenna element is arranged to operate, in addition to a transmission band of a broadband radio system, on at least one frequency band of a second radio system.

11. The antenna structure according to claim 10, wherein the second antenna element is arranged by components, to further operate on at least one frequency band of a fourth radio system, which is below the frequency range of a broadband radio system.

12. The antenna structure according to claim 1, wherein the antenna structure comprises at least one third antenna element, which is coupled to the feeding point and arranged to operate on at least one frequency band of a third radio system, which is below the frequency range of a broadband radio system.

13. The antenna structure according to claim 12, wherein the antenna structure comprises at least one fourth antenna element, which is coupled to the feeding point and arranged to operate on at least one frequency band of a fifth radio system, which is above the frequency range of a broadband radio system.

14. The antenna structure according to claim 13, wherein the third or fourth antenna element is adjustably arranged by components to further operate on at least one frequency band of a sixth radio system, which is above the frequency range of a broadband radio system.

15. The antenna structure according to claim 1, wherein the first antenna element is a T-element.

16. A method for coupling a signal to an antenna structure, which comprises a first antenna element for receiving or transmitting information, the first antenna element being a microstrip antenna, a second antenna element for receiving or transmitting information, the second antenna element being a microstrip antenna, a ground plane for grounding the antenna structure, a coupling line for coupling the first antenna element and the second antenna element to each other, a feeding line for feeding the antenna structure, and which method comprises coupling transmitted and received signals to the antenna structure through one feeding point, wherein the method comprises positioning the first antenna element next to the ground plane and perpendicular to the ground plane; and positioning the second antenna element above the ground plane parallel to the ground plane.

17. The method according to claim 16, wherein the method comprises receiving information on the reception band of a broadband radio system by the first antenna element and transmitting information on the transmission band of said broadband radio system by the second antenna element.

18. The method according to claim 16, wherein the polarisation of the first antenna element differs from the polarisation of the second antenna element.

19. The method according to claim 16, wherein, when receiving signals on a reception band of a broadband radio system that the first antenna element and the coupling line form from the coupling line towards the first antenna element a capacitive load on a transmission band of the broadband radio system, as well as in the frequency range between the transmission and reception bands and also the second antenna element and the coupling line form from the coupling line towards the second antenna element a capacitive load on a reception band of the broadband radio system, as well as in the frequency range of the transmission and reception bands.

20. The method according to claim 16, wherein the method comprises feeding the antenna structure from the point of contact of the coupling line and the second antenna element.

21. The method according to claim 16, wherein the method comprises grounding the antenna structure by coupling the second antenna element to the ground plane in at least one place.

22. The method according to claim 16, wherein the method comprises determining the resonance frequency and adaptation of the first antenna element by at lest one first tuning slot arranged in the first antenna element.

23. The method according to claim 16, wherein the method comprises determining the resonance frequency and adaptation of the second antenna element by at least one second tuning slot arranged in the second antenna element.

24. The method according to claim 16, wherein the method comprises operating with the second antenna element on a transmission band of a broadband radio system and on at least one frequency band of a second radio system.

25. The method according to claim 16, wherein the method comprises operating with a third antenna element on at least one frequency band of a third radio system, which is below the frequency range of a broadband radio system.

26. The method according to claim 25, wherein the method comprises operating further on at least one frequency band of a fourth radio system, which is below the frequency range of a broadband radio system.

27. The method according to claim 16, wherein the method comprises operating with a fourth antenna element on at least one frequency band of a fifth radio system, which is above the frequency range of a broadband radio system.

28. The method according to claim 27, wherein the method comprises operating further on at least one frequency band of a sixth radio system, which is above the frequency range of a broadband radio system.

29. The method according to claim 16, wherein the method comprises using a T-element as the first antenna element.

30. The method according to claim 16, wherein the intercoupling resonance between the first and second antenna elements at the reception or transmission band of a radio system is minimized by strong coupling between the first antenna element and a resonance of the ground plane, which coupling couples the energy stored in an intercoupling resonance arising between the first and second antenna elements to the ground plane resonance which has a better radiation efficiency than what the intercoupling resonance has.

31. An antenna unit, which comprises an antenna structure, which antenna structure comprises a first antenna element for receiving or transmitting information, a second antenna element for receiving or transmitting information, a ground plane for grounding the antenna structure, a coupling line for coupling the first antenna element and the second antenna element to each other, and a feeding line for feeding the antenna structure through one feeding point, wherein the antenna structure is manufactured on an insulating material, which has a base, as well as at least one wall region, which wall region reaches in a direction deviating from the base and which shape of the antenna structure follows the shapes of the base and the wall region, and the first antenna element of the antenna structure is a microstrip antenna and is located next to the ground plane and perpendicular to the ground plane and the second antenna element is a microstrip antenna and is located above the ground plane and parallel to the ground plane.

32. A mobile station, which comprises a first antenna element for receiving or transmitting information, a second antenna element for receiving or transmitting information, a ground plane for grounding the antenna structure, a coupling line four coupling the first antenna element and the second antenna element to each other, and a feeding line for feeding the first and second antenna elements through one feeding point, wherein the first antenna element is a microstrip antenna and is located next to the ground plane and perpendicular to the ground plane and the second antenna element is a microstrip antenna and is located above the ground plane and parallel to the ground plane.

33. The mobile station according to claim 32, wherein the ground plane is an elongated, plane-like element and the first antenna element is placed in the vicinity of one end of the ground plane and the second antenna element is place in the vicinity of the mid-point of the ground plane.

* * * * *